US005767815A

United States Patent [19]

Krebs

[11] Patent Number: 5,767,815

[45] Date of Patent: Jun. 16, 1998

[54] ANTENNA FEEDHORN WITH PROTECTIVE WINDOW

[75] Inventor: Kevin R. Krebs, Plano, Tex.

[73] Assignee: Andrew Corporation, Orland Park, Ill.

[21] Appl. No.: 666,266

[22] Filed: Jun. 20, 1996

[51] Int. Cl.[6] ..... H01Q 1/42; H01Q 13/02

[52] U.S. Cl. ..... 343/786; 343/781 R; 343/872

[58] Field of Search ..... 343/786, 772, 343/872, 781 R; H01Q 13/02, 1/42

[56] References Cited

U.S. PATENT DOCUMENTS

| | | | |
|---|---|---|---|
| 4,504,836 | 3/1985 | Seavey | 343/786 |
| 5,229,736 | 7/1993 | Adams et al. | 343/786 |

*Primary Examiner*—Michael C. Wimer
*Attorney, Agent, or Firm*—Arnold, White & Durkee

[57] ABSTRACT

A feed structure for an antenna, comprising a feed horn having an input end and an output end, a collar threadably engaged to the output end of the feed horn and a protective window interposed between the feed horn and the collar. The collar forms an aperture exposing said window.

10 Claims, 9 Drawing Sheets

ANTENNA FEEDHORN WITH PROTECTIVE WINDOW

FIELD OF INVENTION

The invention relates generally to attachments on feed structures used in antennas. More specifically, the invention relates to attachments which secure windows onto the feed horns of antennas.

SUMMARY OF THE INVENTION

It is an object of the invention to eliminate the need for tap holes and screws in window connection arrangements on feeds in antennas.

A further object of the invention is to provide window connection arrangements that apply uniform pressure across their area.

Still another object of the invention is to provide window connection arrangements with thin windows that are less lossy than conventional window arrangements.

Yet another object of the invention is to provide window arrangements which provide good electrical performance characteristics.

In accordance with the present invention, the foregoing objectives are realized by a feed structure for an antenna, comprising a feed horn having an input end and an output end, a collar threadably engaged to the output end of the feed horn, and a protective window interposed between the feed horn and said collar, the collar forming an aperture exposing said window.

DESCRIPTION OF THE PREFERRED EMBODIMENT

Figure 1:
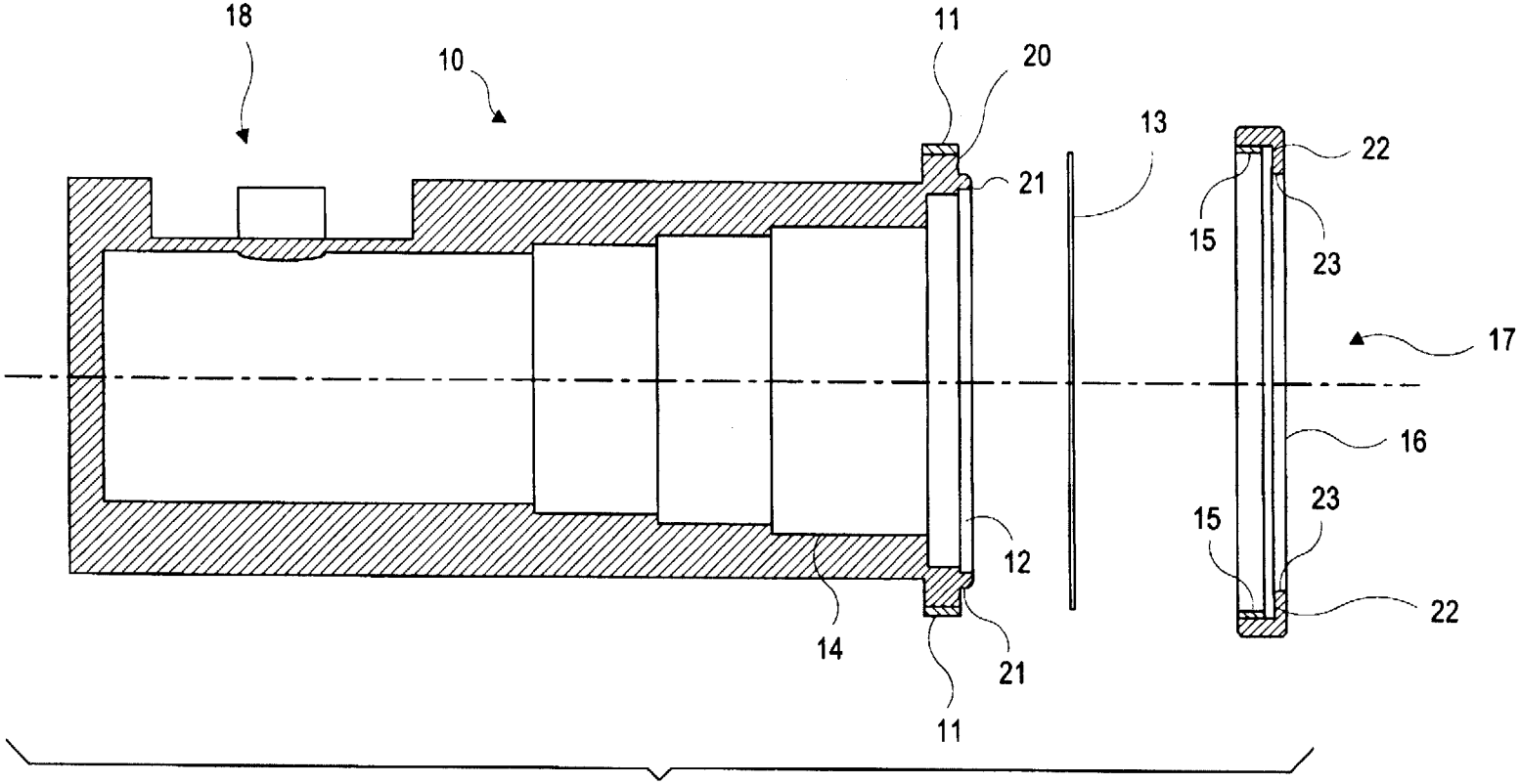
FIG. 1 is a cross-sectional view of the unassembled feed structure of the present invention.

FIGS. 1–5 show an improved feed structure according to principles of the present invention. A feed or feedhorn 10 comprises a circular guide channel 14 centered about a longitudinal axis as shown for guiding electromagnetic energy through its length. The feed terminates in an output area with an end face 20 (generally perpendicular to the longitudinal axis) and a threaded outer surface 11. An opening 12 through end face 20 allows electromagnetic energy to pass between the guide channel 14 of the feed 10 and the exterior of the feed structure. A rectangular guide (not shown) is coupled to the cylindrical feed 10 through a laterally constricted aperture 18 in end portion of the feed 10, the constriction producing the required impedance transformation in the coupling from the rectangular guide to the cylindrical feed 10. A hole 19 is provided for holding a tuning pin which is used for energy direction and impedance matching in the feed. The feed 10 is composed of aluminum, brass, or other similar materials.

For securing the assembly to a collar 17, the end face 20 contains a major annular protrusion 21 which, in this embodiment, is approximately 1.57 millimeters thick for a 7 Ghz feed. For feed horns with different frequencies, the dimensions of the protrusion 21 scale as a function of the frequency of the horn. As will be explained in greater detail below, the major annular protrusion 21 is used to "pinch" a protective window 13 between itself and surfaces of the collar 17 when the feed structure is assembled.

For preventing moisture or other adverse environmental elements from entering the guide channel 14 of the feed 10, as mentioned above, a protective window 13 is sandwiched between the end face 20 of feed 10 and interior face 22 (which is generally perpendicular to the longitudinal axis) and peripheral surface 23 of collar 17. The protective window 13 is composed of halar or another similar moldable plastic material and is typically five one thousandths of an inch thick. Placing the protective window 13 across the end of the feed 10 has a negligible effect on the operation of the feed assembly because the window 13 is virtually transparent to the electromagnetic energy propagated through the feed 10.

Also as mentioned above, for securing the window 13 to the assembly, the collar or iris 17 is provided. The collar 17 contains a threaded inner surface 15 which is threaded onto the threaded outer surface 11 of the feed 10. The dimensions of the collar 17 are selected such that the inside diameter of the collar 17 is slightly larger than the outside diameter of the output area of the feed 10, thereby creating a snug fit between the collar 17 and the feed 10 when the two elements are threaded together. The collar 17 also contains a peripheral surface 23 which is generally perpendicular to the interior face 22 of the collar 17. The collar 17 is constructed of aluminum, brass, or other similar materials and the threaded inner surface 15 of this 7 Ghz embodiment is type M50×1.5.

Figure 4:
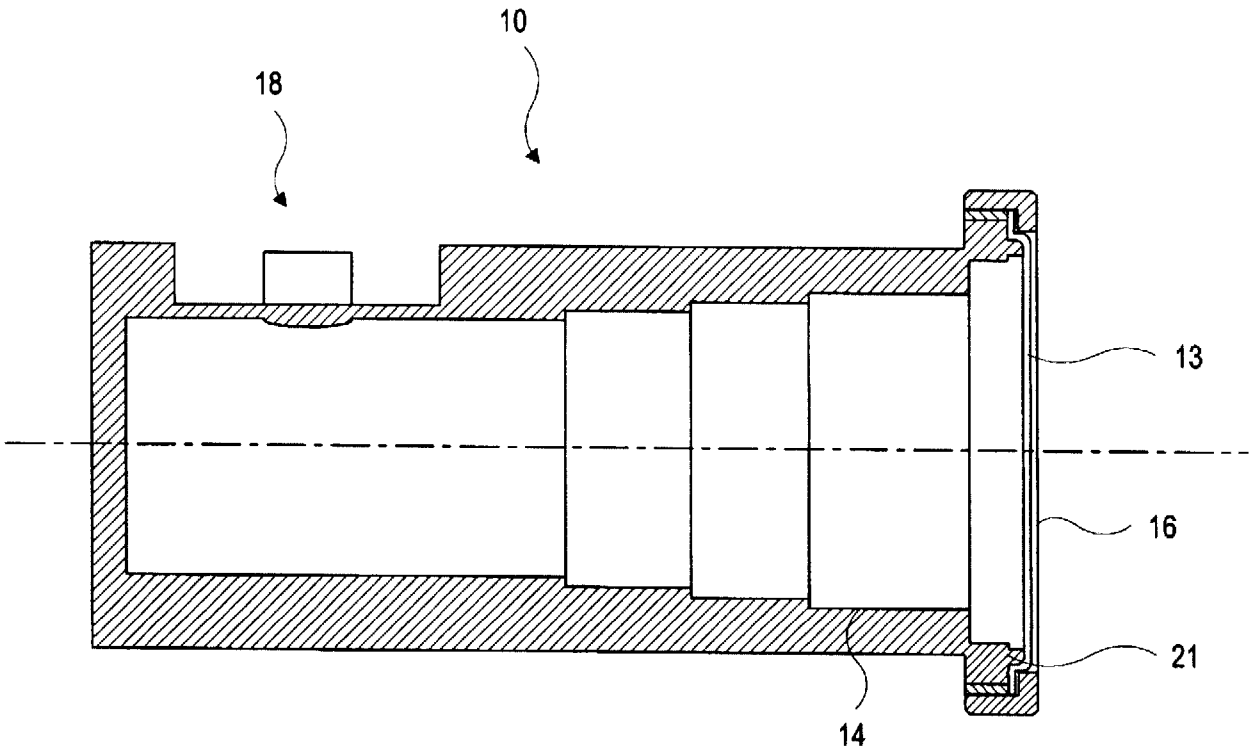
FIG. 4 is a cross-sectional view of the assembled feed structure of the present invention.
Figure 5:
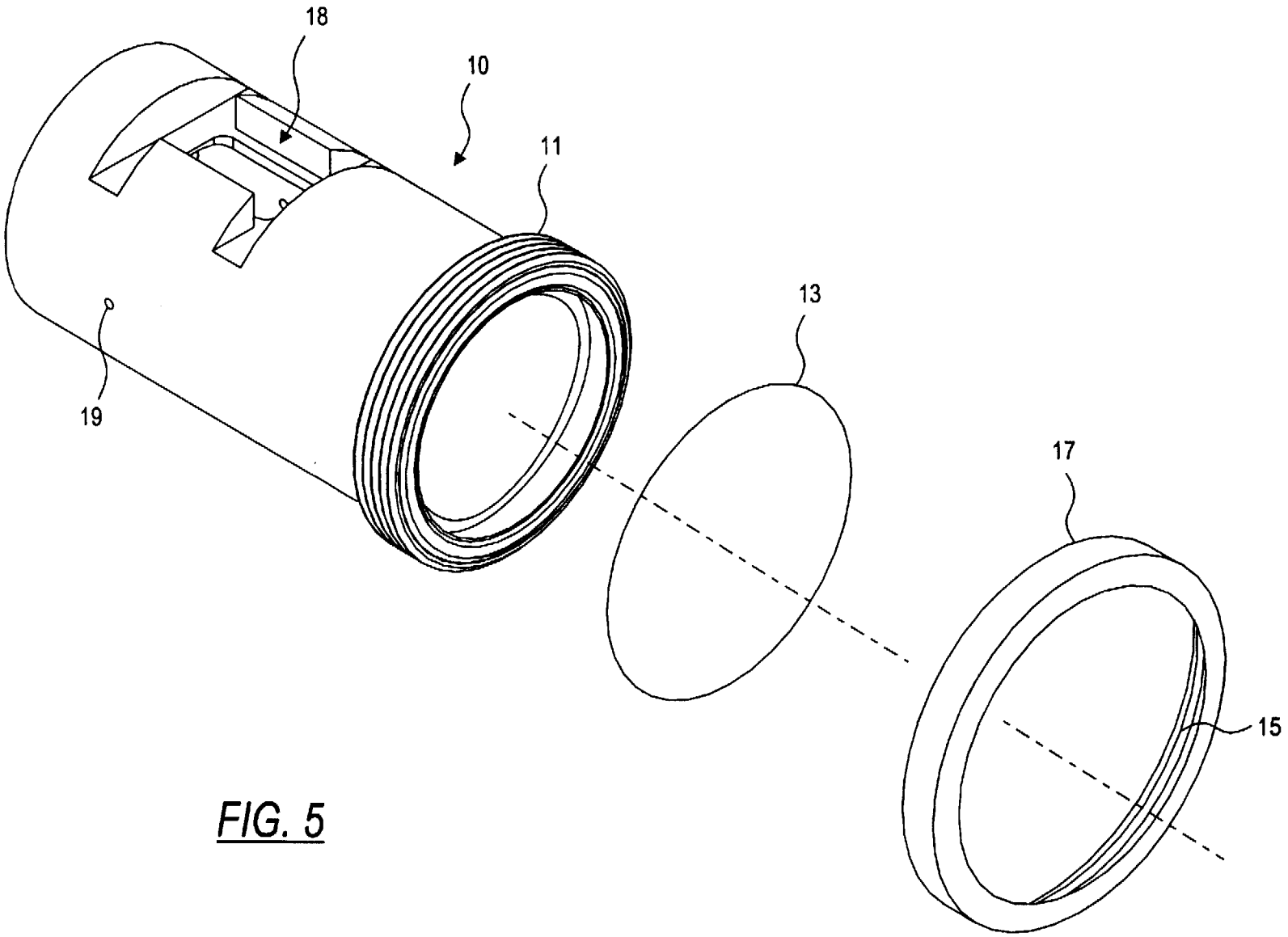
FIG. 5 is a perspective view of the unassembled feed structure of the present invention.
Figure 6:
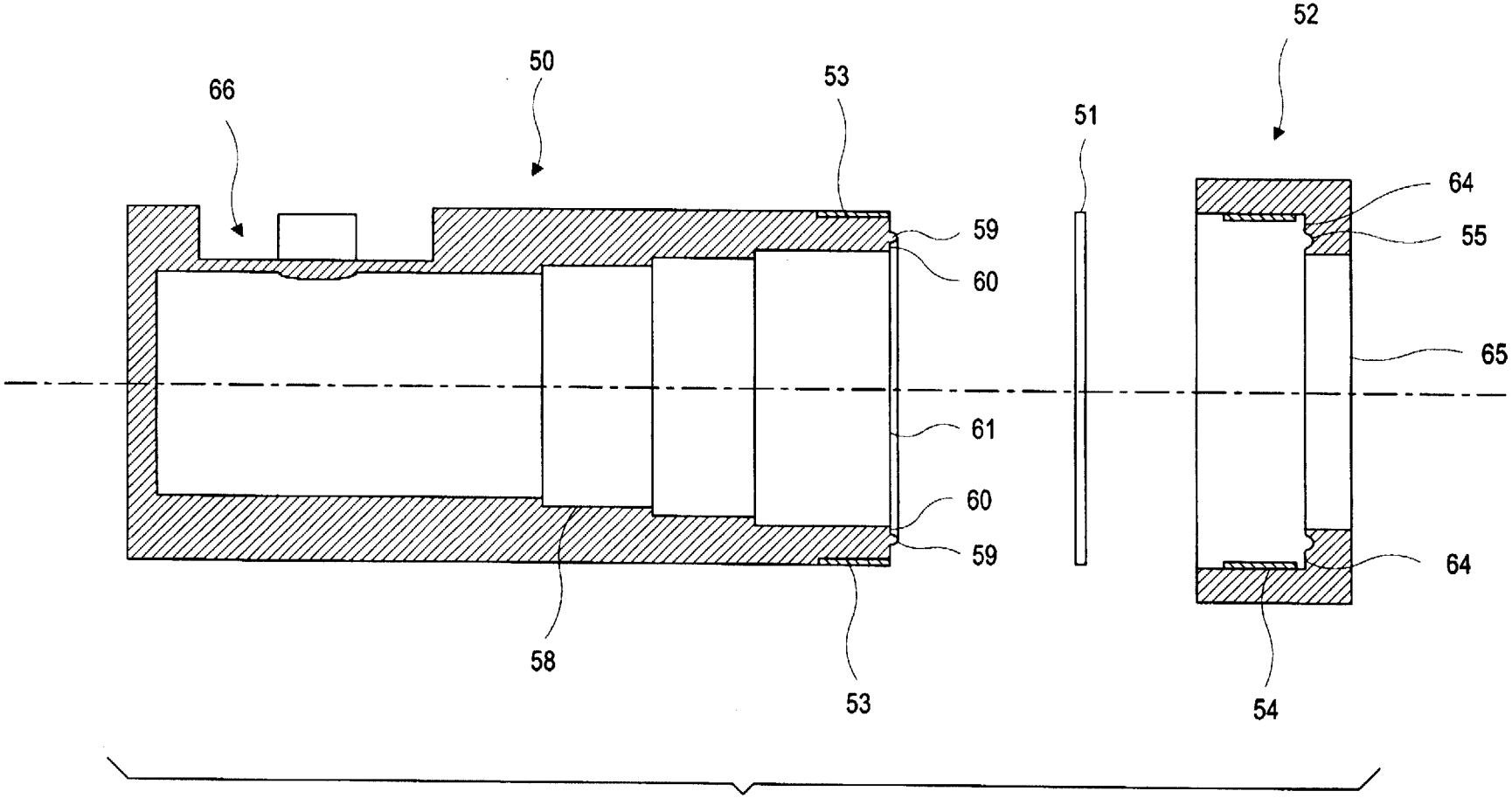
FIG. 6 is a cross-sectional view of another unassembled feed structure of the present invention.

When the feed structure is assembled, the protective window 13 is held between the peripheral surface 23 of the collar 17 and the major annular protrusion 21 of the feed 10. The protective window 13 is of a suitable thickness and composed of a suitable flexible material such that it is "pinched" between the above elements when the feed structure is assembled. That is, the window 13 is effectively molded about the major annular protrusion 21 so that it is secured between the peripheral surface 23 of the collar 17 and the major annular protrusion 21 of the field 10 in the assembled feed structure as shown in FIG. 4. The peripheral surface 23 defines an aperture 16 which exposes the window 13.

Figure 3:
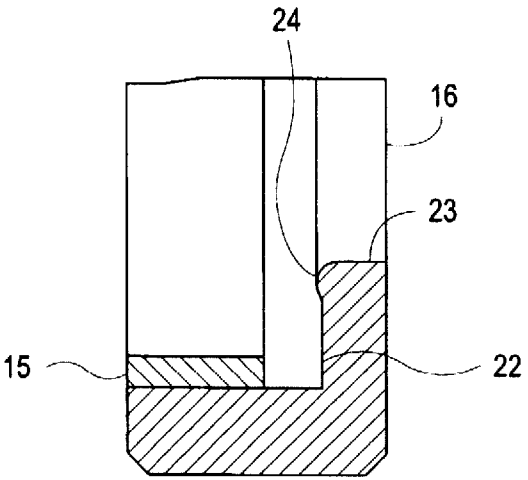
FIG. 3 is a broken-out, enlarged cross-sectional view of an area of a portion of the collar of the feed structure in FIG. 1.
Figure 2:
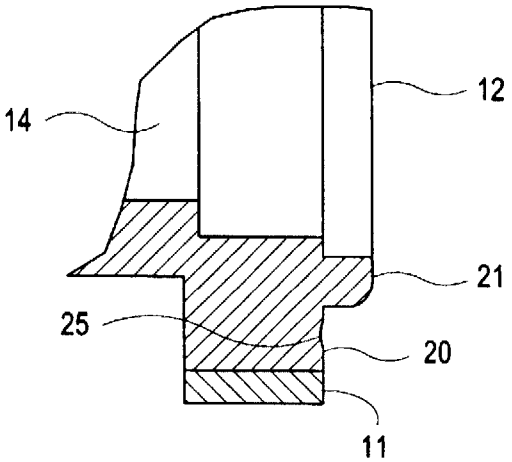
FIG. 2 is a broken-out, enlarged cross-sectional view of an area of the feed of the feed structure in FIG. 1.

As better shown in FIGS. 2 and 3, the interior face 22 of the collar 17 also contains a minor annular protrusion 24 that fits into a corresponding minor annular channel 25 on the end face 20 of the feed 10 for providing additional gripping strength for holding the window 13 in place. The minor annular channel 25 and minor annular protrusion 24 are of suitable dimensions such that the minor annular channel 25 is only slightly bigger than the minor annular protrusion 24 and such that the window 13 can be placed and gripped between these two members. In an alternate embodiment, the collar 17 may contain the minor annular channel and the feed 10 may contain the minor annular protrusion.

The feed structure is assembled as follows. Protective window 13 is placed across the end of the feed 10 and is of sufficient area such that it covers the major annular protrusion 21 and the minor channel 25. The collar 17 is then aligned with the feed 10 about the common longitudinal axis. The two members are then mated together by threading the collar 17 onto the feed 10, rotating the collar clockwise until it fits tightly onto the feed 10. In so doing, as shown in FIG. 4, the protective window 13 is sandwiched in between the collar 17 and feed 10. As shown, the window 13, since it is composed of flexible materials, is molded about the major protrusion 21 and pinched between the major protrusion 21 and the peripheral surface 23 of the collar 17 adjacent to the major protrusion 21 The window 21 is also pinched between the minor protrusion 24 of the collar 17 and minor channel 25 on the feed 10.

FIGS. 6–10 show an alternate embodiment of an improved feed structure according to principles of the present invention. In this embodiment, a stepped internal channel 58 centered on a longitudinal axis traverses a cylindrical feed or feed horn 50, the inner surface of the channel 58 defining a rectangular-to-circular transition. The feed 50 has a threaded outer surface 53 on its exterior surface and is composed of aluminum, brass, or other similar materials.

A rectangular guide (not shown) is coupled to the cylindrical feed 50 through a laterally constricted aperture 66 in end portion of the feed 50, the constriction producing the required impedance transformation in the coupling from the rectangular guide to the cylindrical feed 50. A hole 56 is provided for holding a tuning pin which is used for energy direction and impedance matching in the feed.

For allowing electromagnetic energy to pass, the end face 60, which is generally perpendicular to the longitudinal axis of cylindrical feed 50, contains an opening 61 which is circular and also centered on the axis. The opening 61 has a diameter slightly less than the diameter of end face 60 of the feed 50. An annular protrusion 59 also is formed onto the end face 60 of the cylindrical feed 50. As will be explained in greater detail below, on either side of the annular protrusion 59 on the end face 60 of the cylindrical feed 50 are two annular pinching regions 62 and 63, respectively, which secure a protective window 51 in place when the window 51 is placed between the collar 52 and the cylindrical feed 50.

Figure 9:
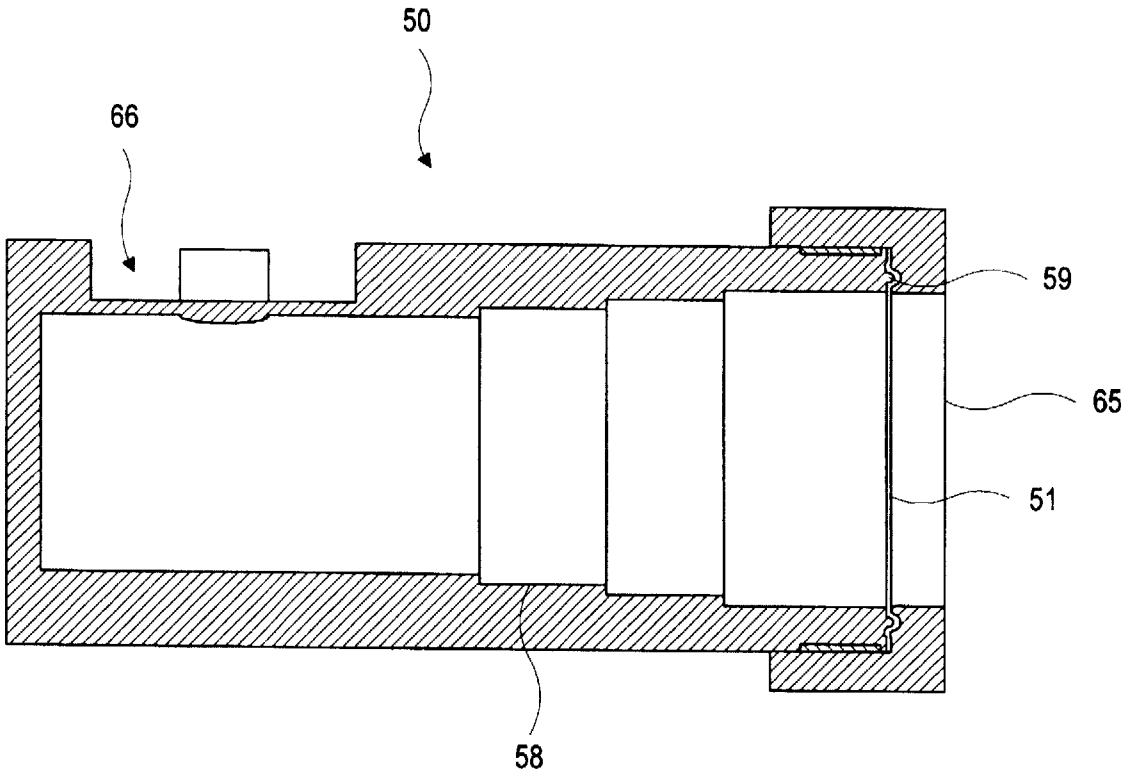
FIG. 9 is a cross-sectional view of the assembled feed structure of the present invention.

For preventing moisture or other adverse environmental elements from entering the internal regions of the feed 50, protective window 51 is sandwiched between the end face 60 of the cylindrical feed 50 and an interior face 64 of collar or iris 52. The interior face 64 is also generally perpendicular to the longitudinal axis. The window 51 is a membrane composed of halar or other similar moldable plastic materials and is typically five one thousandths of an inch thick. Since the window 51 is thin and moldable, when placed over the end face 60 of the feed 50, the window 51 covers the entire face 60 and conforms to the shape of the face 60, including the annular protrusion 59 (FIG.9). The annular protrusion is 1.06 millimeters for a 7 Ghz feed. For feeds of other frequencies, the dimension will scale as a function of frequency. Of course, depending upon the electromagnetic requirements of the feed, the wall thickness of the feed will vary and this embodiment requires a wall of sufficient thickness to hold the protrusion 59. In alternate embodiments, multiple protrusions are possible if the wall is of sufficient thickness.

As mentioned above, for securing the window 51 within the feed structure, collar 52 is provided. The collar 52 contains a threaded inner surface 54 which is threadably engaged to the threaded outer surface 53 of the output end of the feed 50 when the feed structure is assembled. Both threaded surfaces are of type M45×1.5 for a 7 Ghz feed. The collar 52 is constructed out of aluminum, brass, or other similar materials and has an inside diameter that is slightly greater than the outside diameter of the feed 50 so that a snug fit is provided when the collar 52 is threadably engaged onto the output end of the feed 50. The collar 52 also contains a annular channel 55 which receives the annular protrusion 59 on the end face 60 of cylindrical feed 50. The collar 52 has an opening 65 exposing the window 51 and allowing electromagnetic energy to pass.

Figure 8:
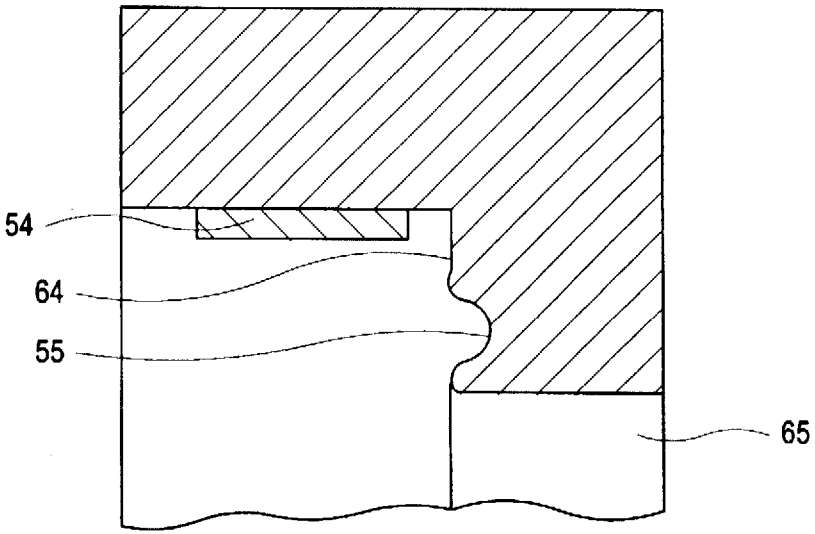
FIG. 8 is a broken-out, enlarged cross-sectional view of an area of the collar of the feed structure in FIG. 6.
Figure 7:
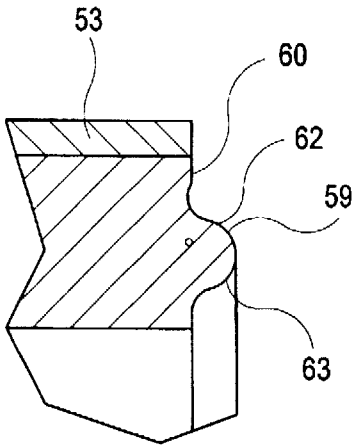
FIG. 7 is a broken-out, enlarged cross-sectional view of an area of the feed of the feed structure in FIG. 6.

When the feed structure is assembled, the window 51 is secured between the collar 52 and cylindrical feed 50 in two regions as illustrated in FIGS. 7 and 8. First, the window 51 is held between the collar 52 and the cylindrical feed 50 at a first annular pinching region 62 which is at a greater radial distance from the longitudinal axis than the peak of the annular protrusion 59. As shown, the first annular pinching region 62 is along the outer surface of protrusion 59. Second, the window 51 is held in place at a second annular pinching region 63 which is at a lesser radial distance from the longitudinal axis than the peak of the annular protrusion 59. As shown, the second annular pinching region 63 is along the inner surface of protrusion 59. The window 51 is constructed of flexible material such that when the collar 52 is mated to the end of the cylindrical feed 50, the window 51 is "pinched" between the interior face 64 of the collar 52 and the end face 60 of cylindrical feed 50 in the two pinching regions 62 and 63, as described above.

Figure 10:
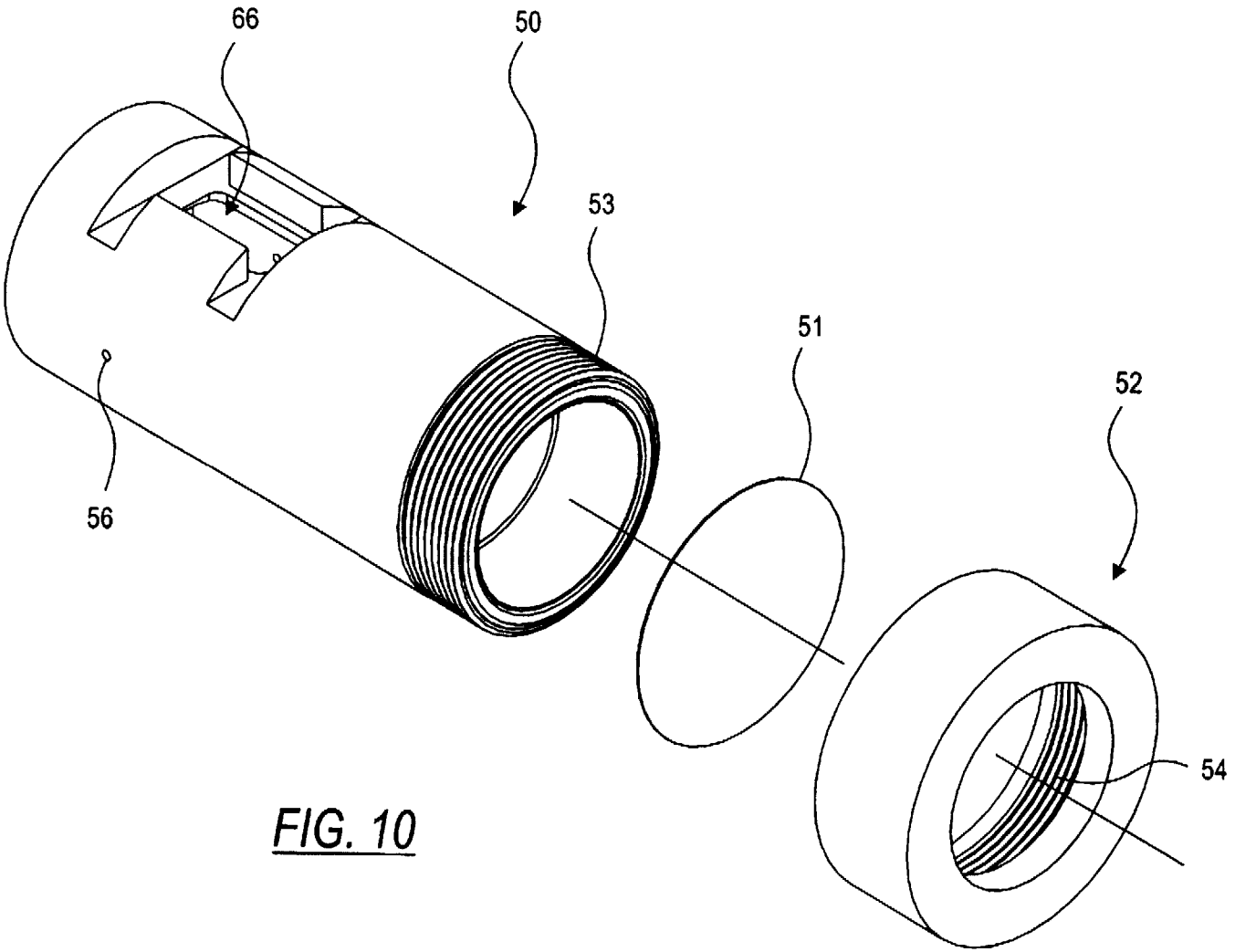
FIG. 10 is a perspective view of the assembled feed structure of the present invention.

The feed structure of the present embodiment is assembled as follows. Protective window 51 is placed across the end face 60 of the cylindrical feed 50. The collar 52 is then aligned along the axis. The two members are then mated together by threading the collar 52 onto the feed 50, rotating the collar clockwise until it fits snugly onto the feed 50. In so doing, as shown in FIG. 10, the window 51 will be sandwiched between the collar 52 and feed 50. The window 51 is held in place because it is pinched between the interior face 64 of the collar 52 and the end face 60 of the feed 50 in the two annular pinching regions 62 and 63, as described above.

It can be seen that the above feed structures do not use screws to attach the collar to the feed. Therefore, the danger of puncturing the window membrane when a user assembles the feed structure is minimal. Using no screws (or predrilled bores) also results in a feed assembly that is less costly to produce. The invention also provides a feed structure which is more durable since a uniform pressure is applied across the window area. The invention also provides a feed structure yielding superior electrical performance since the window and collar have little effect on the operation of the invention.

Figure 11:
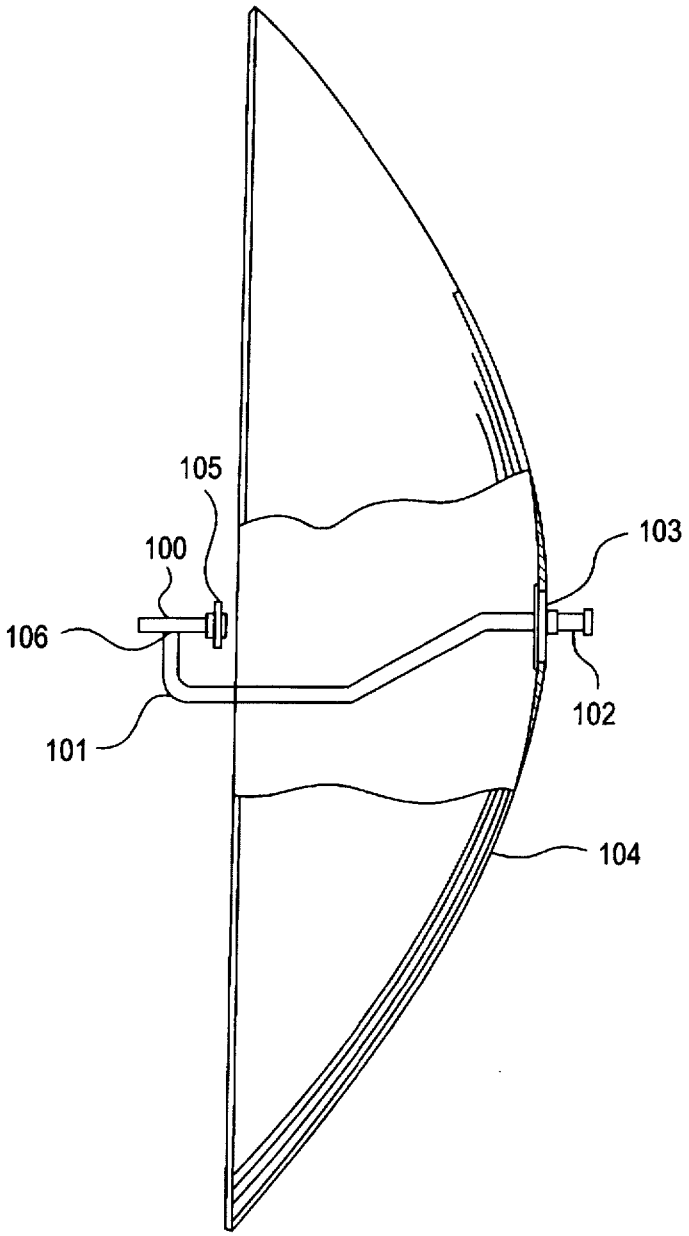
FIG. 11 is a side view of an antenna assembly including the feed structure of the present invention.

Referring now to FIG. 11, the feed structures described above may be used with a parabolic reflector or dish 104. A feed 100 has its mouth 105 at the focus of parabolic reflector 104, and the feed 100 is supported by a waveguide 101 propagating electromagnetic signals. Guide wires which may be employed for stabilization of a portion of the feed, as is conventional in large dish antennas, are omitted from the drawing. A window is attached to the mouth area of the feed 100 using one of the window connection arrangements described above. For illustrative purposes, the window arrangement of FIGS. 6–10 is shown in FIG. 11.

The waveguide 101 extends through a center plate or hub 103 at its inner end and terminates in coupling flange 102. The waveguide is formed in a conventional button-hook shape and has its long dimension, the H-plane dimension, aligned in a common radial plane throughout its length. All bends in the waveguide are in the H-plane so as to minimize the effect of the bends on VSWR, gain reduction, and degraded RF energy pattern propagation.

The rectangular waveguide 101 is coupled to the cylindrical feed 100 through a laterally constricted aperture 106 in end portion of the tube body, the constriction producing the required impedance transformation in the coupling from the rectangular waveguide 101 to the cylindrical feed 100.

In the antenna feed described, the cross-polarized radiation is thus produced closely adjacent to the flared mouth 105 and propagates through only the very short length of the waveguide feed which couples to the mouth. However, it will be readily seen that the same transition or coupling between the rectangular waveguide 101 and the cylindrical feed 100 may be advantageously used whenever it is desired to feed cross-polarized radiation to a circular guide with improved VSWR.

While the present invention has been described with reference to one or more particular embodiments, those skilled in the art will recognize that many changes may be made thereto without departing from the spirit and scope of the present invention which is set forth in the following claims.

I claim:

1. A feed structure for an antenna, comprising:

a feed horn having an input end and an output end;

a collar threadably engaged to said output end of said feed horn;

a protective window interposed between said feed horn and said collar, said collar forming an aperture exposing said window; wherein said feed horn and said collar are aligned with each other along an axis, and wherein said output end of said feed horn includes a first face and said collar includes a second face axially adjacent to said first face, said window being secured between said first and second faces; wherein said window is flexible, and wherein one of said first and second faces forms an annular protrusion and the other of said first and second faces forms an annular channel having a receiving surface, said channel receiving said protrusion with said window disposed between said receiving surface and said protrusion.

2. The feed structure of claim 1, wherein said receiving surface and said protrusion pinch said flexible window along two discrete annular regions.

3. The feed structure of claim 1, wherein said first face forms said protrusion and said second face forms said channel.

4. A feed structure for an antenna, comprising:

a feed horn having an input end and an output end;

a collar threadably engaged to said output end of said feed horn;

a protective window interposed between said feed horn and said collar, said collar forming an aperture exposing said window; wherein said feed horn and said collar are aligned with each other along an axis, and wherein said output end of said feed horn includes a first face and said collar includes a second face axially adjacent to said first face, said window being secured between said first and second faces; wherein said window is flexible, wherein said collar includes a peripheral surface defining said aperture, said peripheral surface being generally perpendicular to said second face, and wherein said first face forms a major annular protrusion and said peripheral surface is radially adjacent to said major protrusion with said window disposed between said peripheral surface and said major protrusion so as to pinch said window along one discrete annular region.

5. The feed structure of claim 4, wherein one of said first and second faces forms a minor annular protrusion and the other of said first and second faces forms a minor annular channel having a receiving surface, said minor protrusion being substantially smaller in amplitude than said major annular protrusion, said channel receiving said minor protrusion with said window disposed between said receiving surface and said minor protrusion.

6. The feed structure of claim 5, wherein said first face forms said channel and said second face forms said minor protrusion.

7. An antenna structure, comprising:

a parabolic reflector including a reflecting surface and a focus;

a waveguide coupled to said parabolic reflector;

a feed horn having an input end and an output end, said input end being connected to said waveguide, said output end being positioned approximately at said focus and directed toward said reflecting surface of said parabolic reflector;

a collar threadably engaged to said output end of said feed horn;

a protective window interposed between said feed horn and said collar, said collar forming an aperture exposing said window; wherein said feed horn and said collar are aligned with each other along an axis, and wherein said output end of said feed horn includes a first face and said collar includes a second face axially adjacent to said first face, said window being secured between said first and second faces; wherein said window is flexible, and wherein said first and second faces are configured to pinch said flexible window along two discrete annular regions; and wherein one of said first and second faces forms an annular protrusion and the other of said first and second faces forms an annular channel having a receiving surface, said channel receiving said protrusion with said window disposed between said receiving surface and said protrusion.

8. The feed structure of claim 7, wherein said first face forms said protrusion and said second face forms said channel.

9. An antenna structure, comprising:

a parabolic reflector including a reflecting surface and a focus;

a waveguide coupled to said parabolic reflector;

a feed horn having an input end and an output end, said input end being connected to said waveguide, said output end being positioned approximately at said focus and directed toward said reflecting surface of said parabolic reflector;

a collar threadably engaged to said output end of said feed horn;

a protective window interposed between said feed horn and said collar, said collar forming an aperture exposing said window; wherein said feed horn and said collar are aligned with each other along an axis, and wherein said output end of said feed horn includes a first face and said collar includes a second face axially adjacent to said first face, said window being secured between said first and second faces; wherein said window is flexible, and wherein said first and second faces are configured to pinch said window along one discrete annular region; wherein said collar includes a peripheral surface defining said aperture, said peripheral surface being generally perpendicular to said second face, and wherein said first face forms a major annular protrusion and said peripheral surface is radially adjacent to said major protrusion with said window disposed between said peripheral surface and said major protrusion so as to pinch said window along one discrete annular region.

10. The feed structure of claim 9, wherein one of said first and second faces forms a minor annular protrusion and the other of said first and second faces forms a minor annular channel having a receiving surface, said minor protrusion being substantially smaller in amplitude than said major annular protrusion, said channel receiving said minor protrusion with said window disposed between said receiving surface and said minor protrusion.

* * * * *